US005143004A

United States Patent [19]

Mardix et al.

[11] Patent Number: 5,143,004

[45] Date of Patent: Sep. 1, 1992

[54] SEWING APPARATUS INCLUDING AUTOMATIC BOBBIN RELOADING

[76] Inventors: Bar-Cochva Mardix, 39/B Harechasim St., Ramat Gan; Yaacov Sadeh, 11/6 Bialik Street, Nes Ziona; Yaacov Makover, Moshav Beit Elazari, all of Israel

[21] Appl. No.: 522,392

[22] Filed: Apr. 30, 1990

Related U.S. Application Data

[63] Continuation of Ser. No. 235,148, Aug. 23, 1988, abandoned.

[30] Foreign Application Priority Data

Nov. 25, 1987 [IL] Israel ..... 84584

[51] Int. Cl.[5] ..... D05B 59/04

[52] U.S. Cl. ..... 112/186; 112/180; 112/278

[58] Field of Search ..... 112/181, 186, 279, 180, 112/278, 273

[56] References Cited

U.S. PATENT DOCUMENTS

| | | | |
|---|---|---|---|
| 2,808,795 | 10/1957 | Wortham | 112/186 X |
| 4,002,130 | 1/1977 | Rovin et al. | 112/186 X |
| 4,223,618 | 9/1980 | Cislak | 112/186 |
| 4,681,050 | 7/1987 | Kosmas | 112/180 X |
| 4,693,196 | 9/1987 | Hager | 112/278 X |

FOREIGN PATENT DOCUMENTS

| | | | |
|---|---|---|---|
| 764089 | 8/1971 | Belgium | 112/186 |
| 908215 | 10/1962 | United Kingdom | 112/186 |

*Primary Examiner*—Peter Nerbun
*Attorney, Agent, or Firm*—Benjamin J. Barish

[57] ABSTRACT

Sewing apparatus comprises a sewing needle, a bobbin for feeding thread to the sewing needle, a rotary housing containing the bobbin and its case a sensor for sensing the non-feeding of thread to the sewing needle; an extraction-reloading device automatically effective, upon sensing the non-feeding of the thread to the sewing needle, for first extracting the bobbin and its case from the rotary housing, then extracting the bobbin from its case, then reloading the case with another bobbin having a supply of thread thereon and then returning the case with its reloaded bobbin into the rotary housing.

17 Claims, 11 Drawing Sheets

FIG 5a (PRIOR ART)
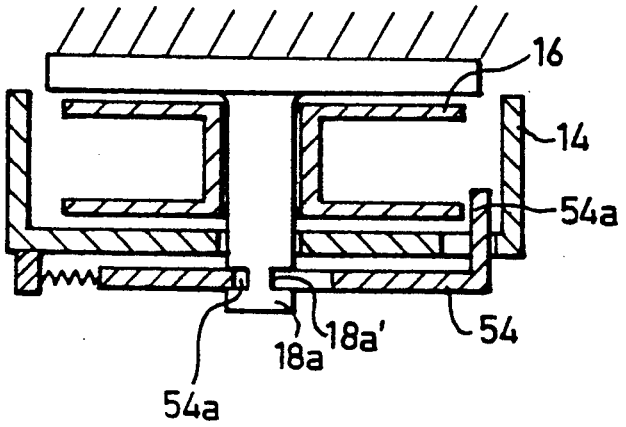
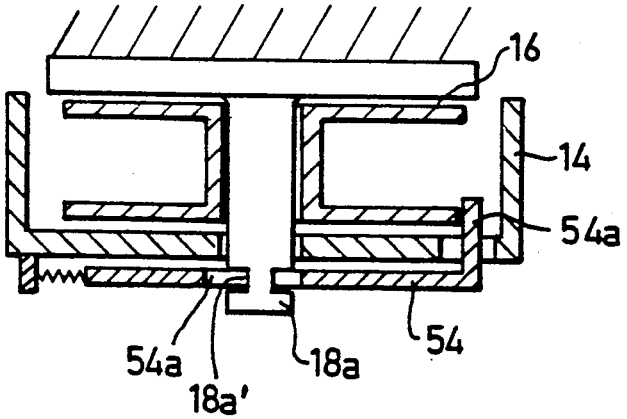
FIG 5B (PRIOR ART)

FIG 8i
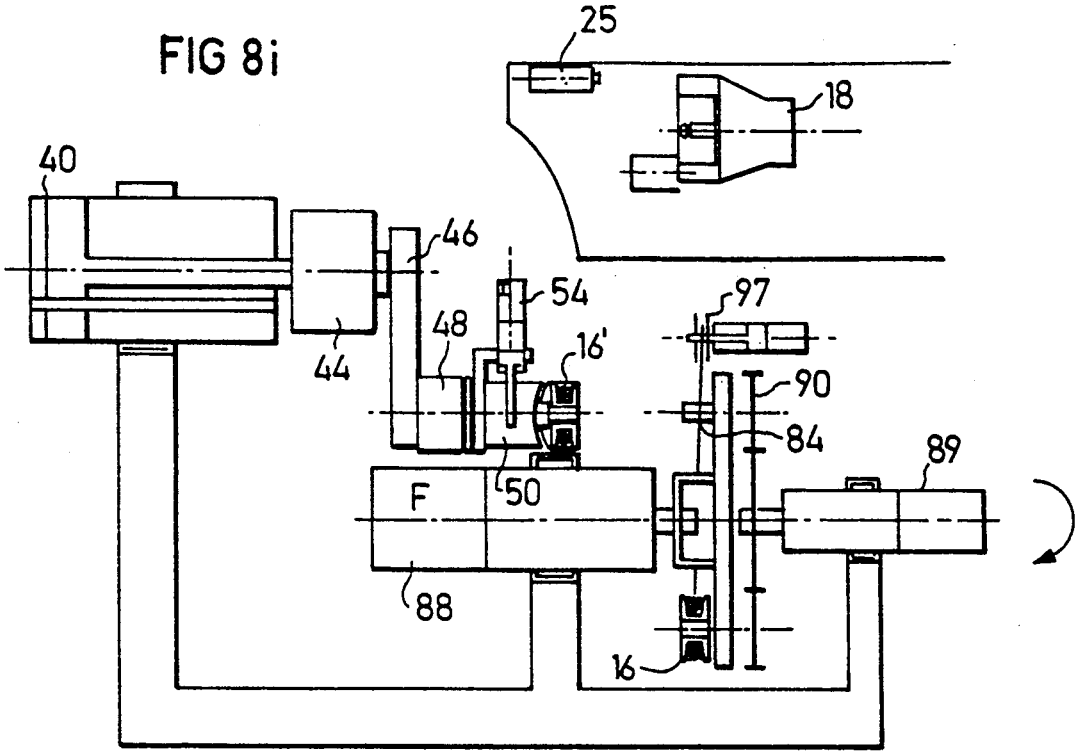
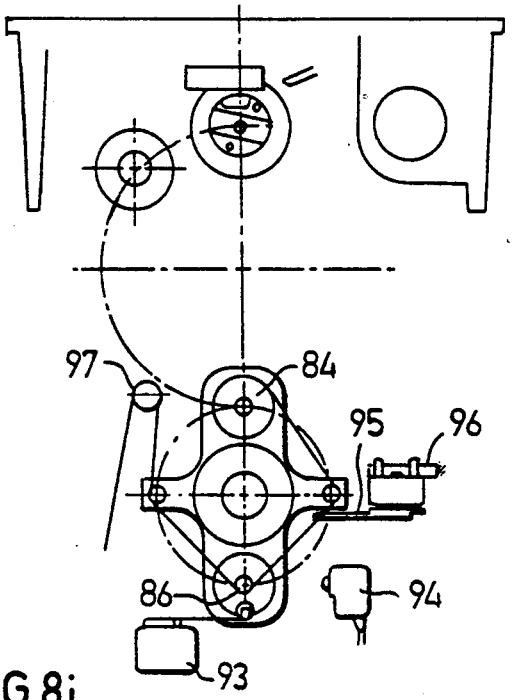
FIG 8j

FIG 8ℓ

SEWING APPARATUS INCLUDING AUTOMATIC BOBBIN RELOADING

RELATED APPLICATION

The present application is a continuation of application Ser. No. 07/235,148, filed Aug. 23, 1988, now abandoned, and is related to copending application Ser. No. 07/235,147, filed Aug. 23, 1988, now U.S. Pat. No. 4,934,292.

BACKGROUND OF THE INVENTION

The present relates to sewing apparatus, and particularly to such apparatus including an arrangement for automatically reloading the bobbin upon the occurrence of a break or exhaust condition in the bobbin thread. The sewing apparatus of the present invention is especially, but not exclusively, useful with the bobbin-thread monitoring arrangement described in U.S. Pat. No. 4,934,292, filed concurrently herewith, as will be described more particularly below.

The known sewing machines commonly include various means for feeding an upper thread to the sewing needle, and other means for feeding the lower or bobbin thread to the sewing needle. Monitoring the condition, particularly breakage, of the upper thread is relatively simple, and several methods are in use today, as described for example in U.S. Pat. No. 3,843,883. However, monitoring the condition of the lower or bobbin thread is somewhat more problematical, and although a number of systems have been devised for doing this, the known systems are still not entirely satisfactory. The main reason for this is because of the complexity of the path of the lower thread out of the bobbin, which enables very little room for detection of breakage.

Further, in the known sewing machines, should the lower bobbin thread cease to feed, e.g., because of a break or because of the exhaustion of the thread on the bobbin, it is usually necessary to stop the sewing machine, pull out the bobbin, and reinsert another bobbin having a fresh supply of thread. These operations are both labor-consuming and time-consuming, and therefore substantially reduce the productivity of the sewing machine.

An object of the present invention is to provide sewing apparatus including an arrangement for automatically monitoring the feeding of the bobbin thread, and for automatically reloading the bobbin should the bobbin cease to feed thread.

BRIEF SUMMARY OF THE INVENTION

According to the present invention, there is provided sewing apparatus comprising a reciprocating sewing needle, and a bobbin within a case for feeding thread to the sewing needle. The bobbin and its case are disposed within a rotary housing which is rotated in synchronism with the reciprocations of the sewing needle. The apparatus further includes sensor means for sensing the non-feeding of thread to the sewing needle; and extraction-reloading means automatically effective upon sensing the non-feeding of the thread to the sewing needle for first extracting the bobbin and its case from the rotary housing, then extracting the bobbin from its case, then automatically reloading the case with with another bobbin having a supply of thread thereon, and then returning the case with its reloaded bobbin into the rotary housing.

According to another feature of the present invention, the sewing apparatus further includes a bobbin rewinder including: a first station for receiving the bobbin extracted by the extraction-reloading means; a second station for holding a rewound bobbin containing a supply of thread thereon to be used in automatically reloading the sewing machine; means for shifting the extracted bobbin from the first station to the second station; and thread rewinding means at the second station for rewinding a supply of thread on the bobbin in the second station.

Further features and advantages of the invention will be apparent from the description below.

BRIEF DESCRIPTION OF THE DRAWINGS

The invention is herein described, by way of example only, with reference to the accompanying drawings, wherein:

FIGS. 5*a* and 5*b* are transverse sectional views illustrating a conventional bobbin and bobbin case construction, FIG. 5*a* showing the parts in the normal sewing condition wherein the bobbin case is locked to the bobbin housing and the bobbin is released for rotation during the sewing operation, whereas FIG. 5*b* shows the parts in the condition for removing a bobbin and case from the housing wherein the bobbin is locked to the case and the case is released from the housing;

FIGS. 8*a*–8*l* illustrate the overall operation of the described sewing apparatus.

DESCRIPTION OF A PREFERRED EMBODIMENT

Reference is first made to FIGS. 1–4 illustrating the monitoring arrangement for monitoring the condition of the bobbin thread and also the structure of the bobbin. The monitoring arrangement and bobbin structure, as illustrated in FIGS. 1–4, are the same as described in U.S. Pat. No. 4,934,292.

Figure 1:
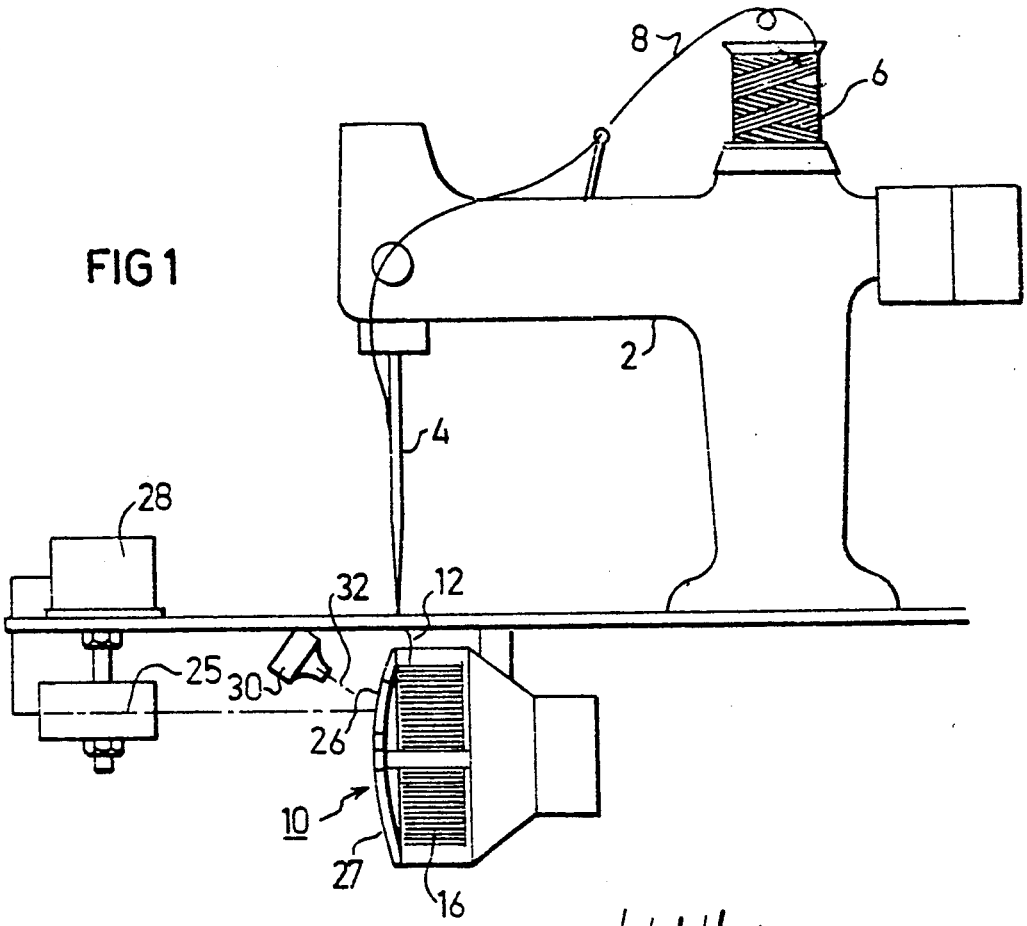
FIG. 1 is a side elevational view illustrating the main components of sewing apparatus equipped with a thread-monitoring device in accordance with the present invention.

FIG. 1 illustrates a sewing machine head, generally designated 2, including a reciprocating sewing needle 4, a spool 6 for feeding an upper thread 8 to the sewing needle, and a lower-thread unit 10 for feeding the lower thread 12 to the sewing needle. The lower thread unit 10, as more particularly illustrated in FIG. 2, comprises a case 14 and a bobbin 16 disposed within the case and containing a supply of the lower thread 12. Unit 10 further includes a rotary housing 18 which is rotated in synchronism with the reciprocation of the sewing needle 4, the pressure foot 20, and the other components of the sewing machine, so as to form stitches with the upper thread 8. The general construction and mode of operation of such sewing machines are well-known, and therefore further details not essential to an understanding of the present invention are not set forth herein.

Unit 10 for the lower-thread, or bobbin-thread, is provided with a monitoring device for monitoring the bobbin thread to indicate either a broken-thread or an exhausted-thread condition. Unit 10 is also provided with an arrangement to maintain the thread relatively tight on the bobbin, and with a further arrangement to facilitate rewinding the bobbin with an additional supply of thread when the original supply has become exhausted.

Figure 2:
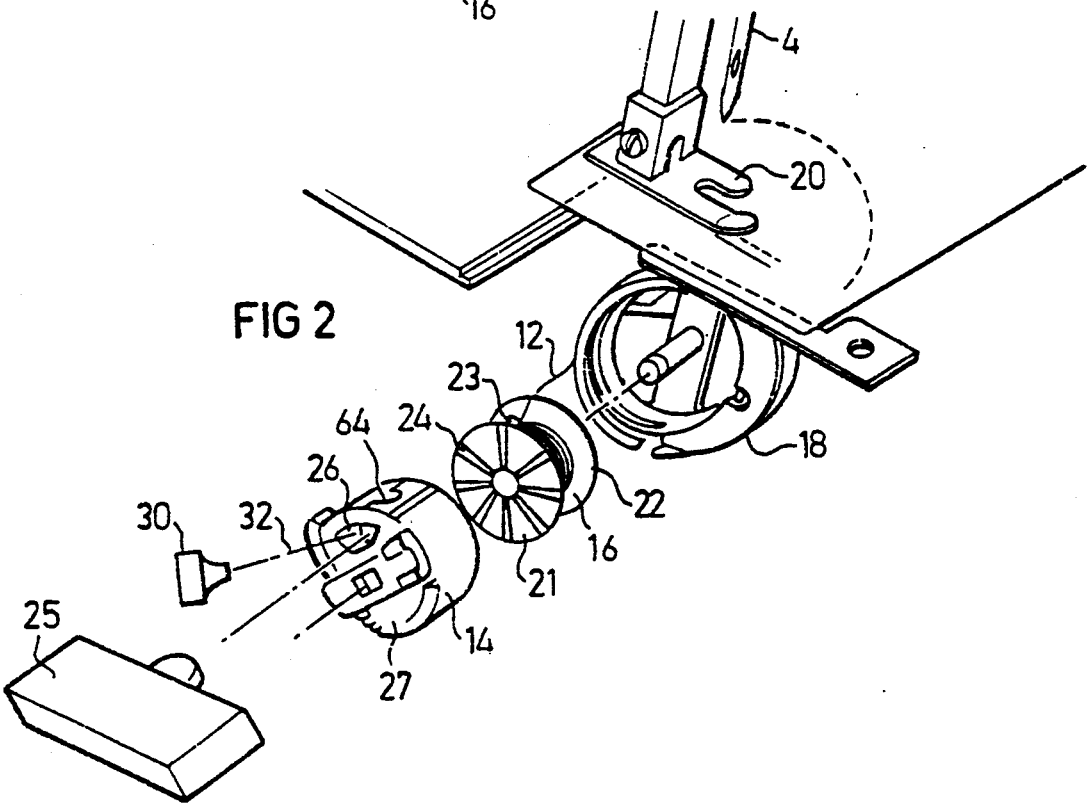
FIG. 2 is an exploded three-dimensional view illustrating the main components of the bobbin thread-monitoring device in the sewing apparatus of FIG. 1.
Figure 3:
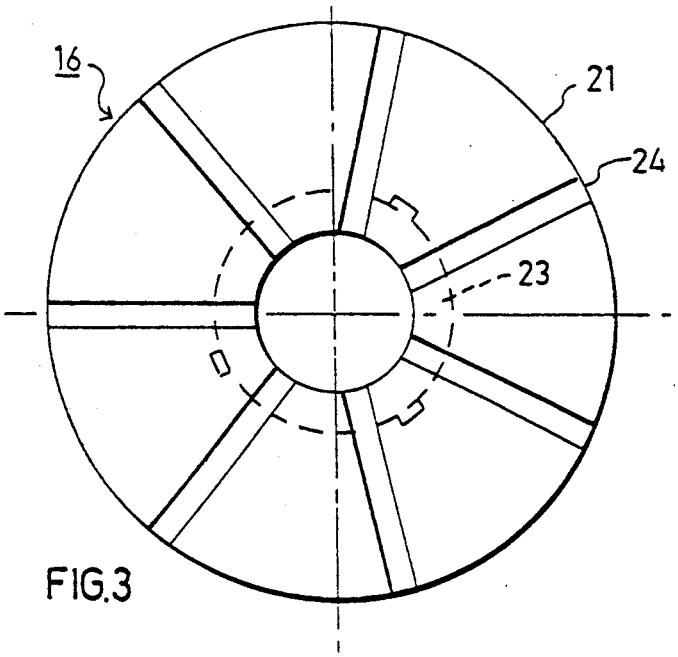
FIG. 3 is an enlarged side elevational view illustrating the end wall of the lower bobbin in the sewing apparatus of FIGS. 1 and 2.
Figure 4:
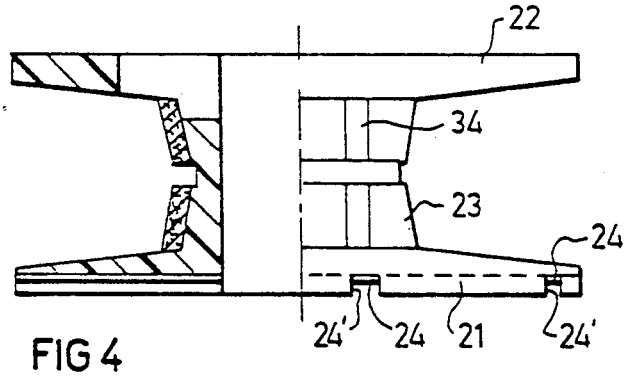
FIG. 4 is an end view, partly in section, illustrating the bobbin of FIGS. 1–3.

As shown particularly in FIGS. 2 and 4, the bobbin 16 is provided with a pair of end walls 21, 22 interconnected at their centers by an axle 23 for receiving the thread 12 wound on the axle. The outer face of one of the end walls 21 is formed with a plurality of strips 24 of an optically-sensible material extending radially from the center of the end wall. Thus, strips 24 may be of dark color (e.g., black) so as to be optically distinguishable from the lighter color (e.g., white) of the remainder of end wall 21. Strips 24 are sensed by an optical sensor 25 aligned with an opening 26 in an end wall 27 of the bobbin case 14, as shown in FIG. 2. The arrangement is such that when bobbin 16 is rotating, stripes 24 on end wall 21 generate, in optical sensor 25, a series of pulses which thereby indicate not only the fact that the bobbin is rotating, but also its rotational velocity.

The pulses generated by optical sensor 25 are fed to a unit 28 (FIG. 1) which may include an indicator for indicating whether or not the bobbin is rotating, and/or its rotational velocity. Unit 28 may also include a control for automatically controlling the sewing machine in response to this information, e.g., for automatically stopping the sewing machine should the bobbin cease to rotate, thereby indicating either a break in the bobbin thread or its exhaustion. Control unit 28 is effective, upon sensing a thread-breakage or a thread-exhaustion condition, to effect the automatic withdrawal of the bobbin and its replacement with another bobbin having a full supply of thread.

As shown particularly in FIG. 4, the colored stripes 24 formed in end wall 21 of the bobbin 16 are recessed so as to be offset from the plane of the bobbin end wall 21. By this construction, stripes 24 define a plurality of radially-extending vanes, schematically indicated at 24'. These vanes are impinged by an air jet from a nozzle 30 (FIGS. 1 and 2) aligned with opening 26 in the bobbin case 14. Nozzle 30 is oriented obliquely with respect to the axis of bobbin 16 so that its air jet 32 impinges vanes 24' and applies a force tending to rotate the bobbin in the direction for tightening the thread 12 on the bobbin.

As further shown particularly in FIG. 4, axle 23 of the bobbin is provided on its outer face with a plurality of axially-extending strips 34 of a friction material, such as sandpaper or other material having a roughened surface, for catching the thread when the thread is to be automatically wound on the bobbin. Strips 34 are of a color which is optically distinguishable from the color of the remainder of the bobbin axle 23; for example, strips 34 may be black, whereas the remainder of the bobbin axle 23 may be white. Strips 34 are used, as described below, for optically detecting whether a bobbin, which is rotated preparatory to receiving a supply of thread to be wound thereon, is actually empty.

The structure of the bobbin 16, and the arrangement for monitoring the condition of its thread 12 as illustrated in FIGS. 1–4, are more particularly described in the above-cited patent Ser. No. 07/235,147, now U.S. Pat. No. 4,934,292, filed concurrently with the present application. The remainder of the description, therefore, relates to the arrangement which is automatically responsive to detect the non-rotation of the bobbin (thereby indicating a broken-thread or an exhaust-thread condition), to extract the bobbin from the sewing machine, and to reload another bobbin having a fresh supply of thread thereon.

Figure 5:
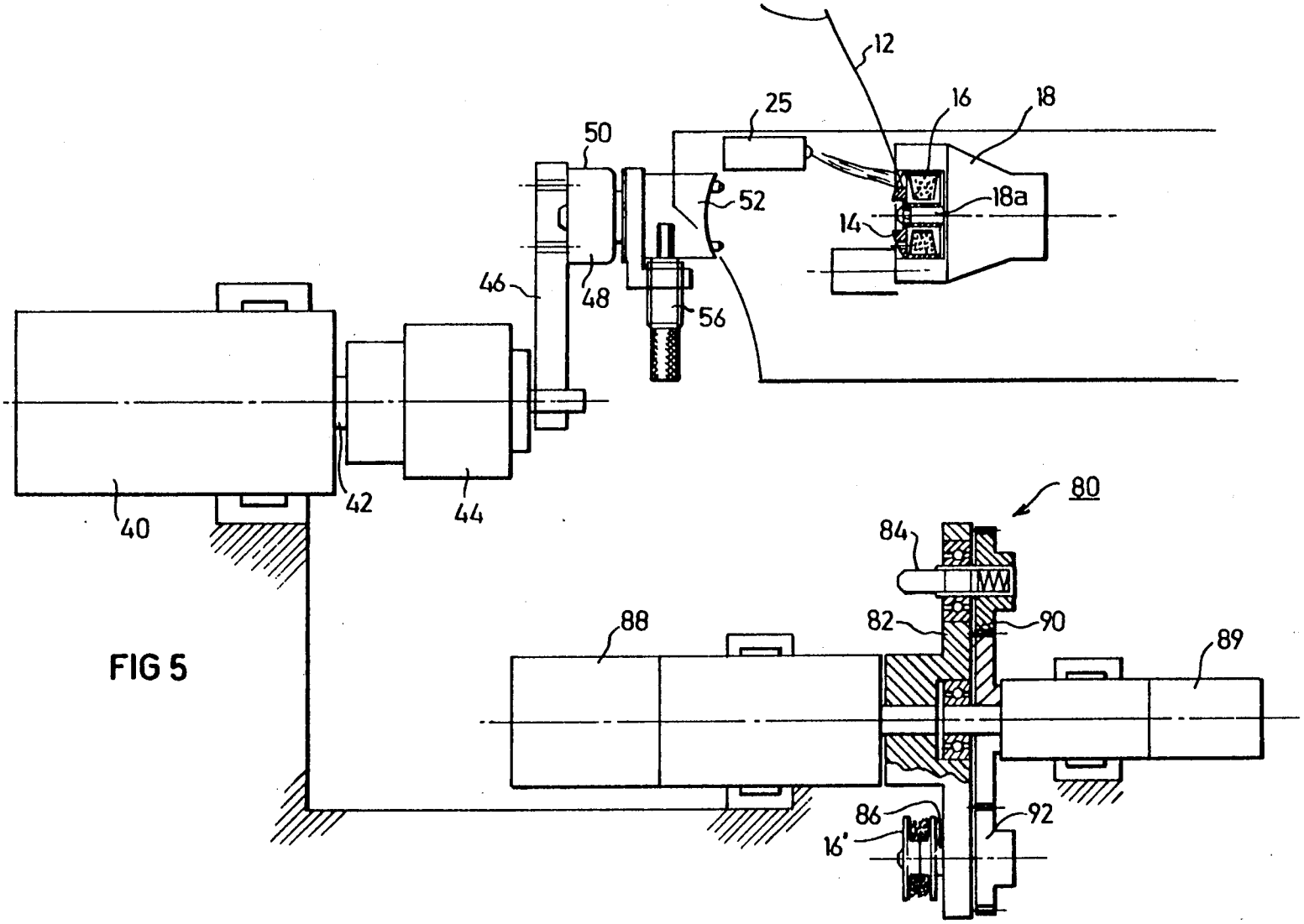
FIG. 5 is a diagrammatic view illustrating sewing apparatus equipped with an arrangement in accordance with the present invention for automatically extracting a bobbin which has ceased to feed thread, and for automatically reloading another bobbin in place thereof.

The automatic bobbin-reloading arrangement is illustrated in FIG. 5. This figure also illustrates an arrangement for rewinding the empty bobbin so that a bobbin containing a fresh supply of thread will always be available for replacing a bobbin extracted from the sewing apparatus.

Thus, FIG. 5 illustrates the bobbin 16 disposed within a bobbin case 14 in the bobbin housing 18 rotatable about a shaft **18*a*, and also the optical sensor 25 which monitors the rotation of the bobbin case 14 to assure that the bobbin thread 12 is being properly fed to the sewing needle. As indicated earlier, when optical sensor 25 detects that the bobbin case 14 is no longer rotating, thereby indicating a broken-thread or an exhausted-thread condition, the optical sensor actuates the bobbin-reloading system to automatically reload a fresh bobbin in housing 18**.

The automatic bobbin-reloading system, as illustrated in FIG. 5, comprises a linear actuator 40 adapted to reciprocate a piston 42 carrying a rotary actuator 44 which, in turn, is adapted to rotate an arm 46 through an arc of 180°. The end of arm 46 carries another rotary actuator 48 carrying an extraction head 50 at one end, which head is rotated through an arc of 45° upon energization of the rotary actuator 48. Extraction head 50 includes an electromagnet, shown schematically at 52, which, when energized, securely holds the bobbin casing 14, and also the bobbin 16 when secured thereto.

The bobbin 16, bobbin case 14, housing shaft **8*a* and operator 54 carried by the housing 18 are of conventional construction as illustrated in FIGS. 5*a* and 5*b*. FIG. 5*a* illustrates the above parts during a normal sewing operation, whereas FIG. 5*b* illustrates the parts when a bobbin case, including the bobbin, is to be removed from the bobbin housing 18**.

Figure 6A:
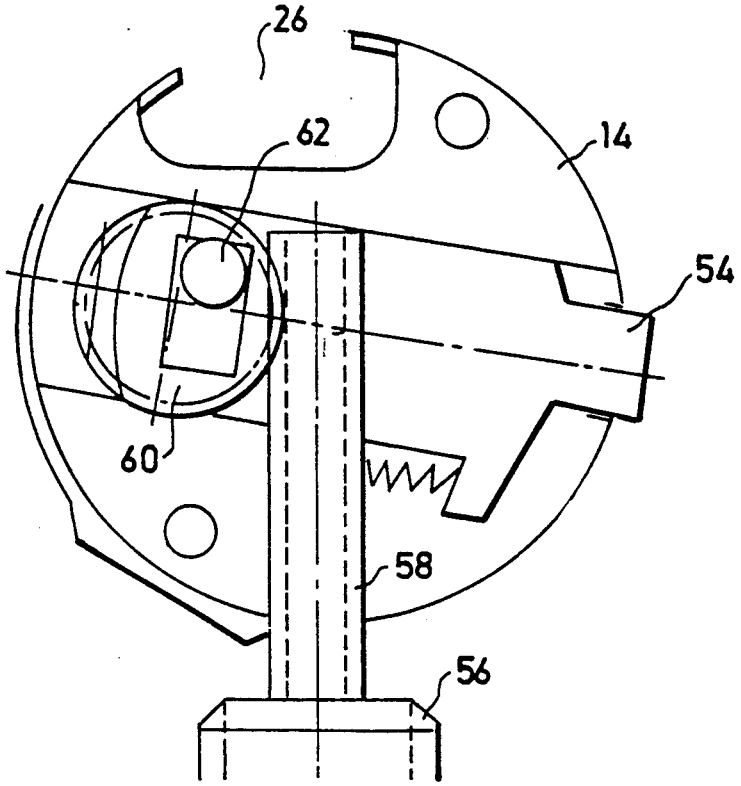
FIGS. 6*a* and 6*b* more particularly illustrate the releasing means in the arrangement of FIG. 5 for releasing the bobbin and bobbin case from the bobbin housing.

Thus, in a normal sewing operation, the operator 54 is in its outer (extended) position as shown in FIGS. **5*a* and 6*a*, at which time a slot 54*a*, formed in the operator 54, is received within an annular groove 18*a'* formed in the end of the housing shaft 18*a* to lock the bobbin case 14 to the shaft; in addition, an outturned extension 54*b* formed in the operator 54 is disengaged from the edge of the bobbin 16, to release the bobbin from the case, thereby permitting the bobbin to rotate during the normal sewing operation. FIG. 6*a* illustrates the position of the piston stem 58 during a normal sewing operation, wherein the stem is in its retracted position (having been retracted by electromagnet 52), which moves operator 54 to its extended (FIG. 5*a***) position.

Figure 6B:
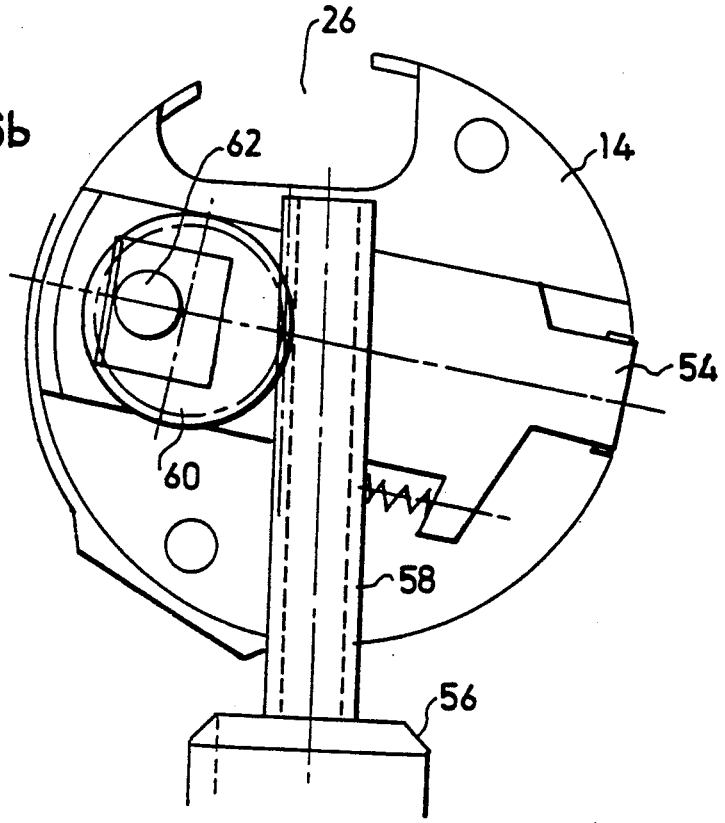

In order to remove the bobbin 16 and case 14 from housing shaft **18*a*, piston stem 58 is moved to its extended position as illustrated in FIG. 6*b*. This movement of stem 58 moves the operator 54** to its inner (retracted) position as illustrated in FIGS. 5*b* and 6*b*. As shown particularly in FIG. 5*b*, when operator 54 is so moved to its inner (retracted) position, its outturned extension 54*b* engages the bobbin 16, thereby locking the bobbin to the case 14; in addition, slot 54*a* of operator 54 unseats from groove 18*a* of the housing shaft 18*a*, thereby releasing the bobbin case, and the bobbin with it, from the housing shaft.

Operator member 54 is movable either to its normal locking position (FIG. 6*a*), or to its releasing position (FIG. 6*b*) by a linear actuator 56 which moves an externally-threaded piston stem 58 with respect to a threaded pin 60 coupled to operator member 54 by an eccentric mounting 62, all mounted to housing 50. Thus, when piston stem 58 is in its normal (retracted) position as illustrated in FIG. 6*a*, operator member 54 is in its outer (locking) position, locking the bobbin case 14 to the shaft 18*a* of the housing 18 during the normal operation of the sewing apparatus; however, when the bobbin 16 is to be detached with its casing 14 from housing shaft 18*a*, for replacement by a new bobbin, actuator 56 is actuated to move piston stem 58 to its extended position as illustrated in FIGS. 6*b*, which thereby rotates pin 60 and its eccentric mounting 62 to move operator 54 to its inner position, locking the bobbin to the case and releasing the case from housing shaft 18*a*.

Figure 7A:
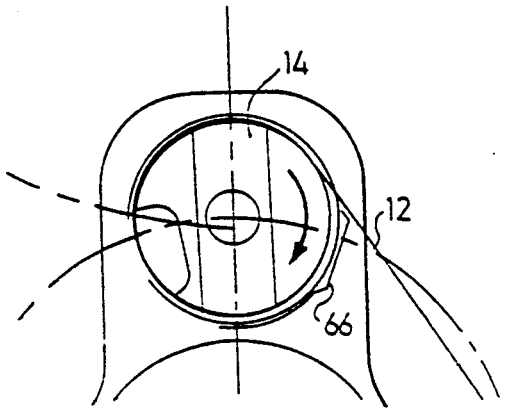
FIGS. 7*a* and 7*b* illustrate the operation of one of the actuators to insert the thread in a fresh bobbin under its tensioning spring.
Figure 7B:
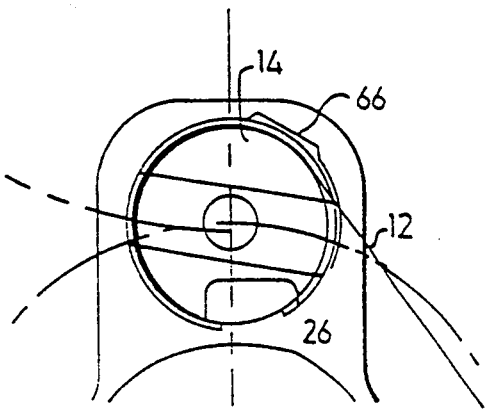

The conventional bobbin case construction includes the conventional diagonal slot, shown at 64, FIG. 2, in its side wall for receiving the thread when the bobbin within a case is to be refilled with thread. Such a conventional bobbin case construction also includes a spring, shown at 66 in FIGS. 7*a* and 7*b*, which presses the bobbin thread 12 against the side wall of the case in order to tension the thread. The operation of inserting the bobbin thread 12 under the tension spring 66 is performed by the rotary actuator 48 (FIG. 5) which, after the bobbin thread has been received on the bobbin within the case, rotates the case and bobbin through an angle of 45° to pass the bobbin thread 12 under the tension spring 66 causing the thread to be guided under the spring along the diagonal slot 64, as is commonly done in any bobbin case. FIG. 7*a* illustrates the bobbin case 14 and the thread 12 after the thread has been applied to the bobbin within the case, and FIG. 7*b* illustrates the bobbin case after having been rotated 45° by the rotary actuator 48 to bring the thread 12 under the tension spring 66.

The apparatus illustrated in FIG. 5 further includes a bobbin rewinder, generally designated 80, which receives the empty bobbin from the extraction head 50, supplies a refilled bobbin to the extraction head for introduction into the bobbin housing 18 of the sewing apparatus, and rewinds the empty bobbin to thereby make it available for use during the next reloading operation.

As shown in FIG. 5, the bobbin rewinder 80 comprises a rotatable turret 82 having an upper bobbin holder 84 and a lower bobbin holder 86. During a reloading operation, the upper bobbin holder 84 is at a first station for receiving the empty bobbin from the extraction head 50; turret 82 is rotated to bring the full bobbin 16' in the lower bobbin holder 86 to the upper position, and the empty bobbin to the lower position; and the extraction head 50 is then operated to load the full bobbin 16' into the bobbin housing 18 of the sewing apparatus, in order to permit the apparatus to continue the sewing operation. During the sewing operation, the empty bobbin in the lower bobbin holder 86 at a second station is rewound with a fresh supply of thread so that it will be available for use in the next reloading operation.

The rotation of the bobbin holder turret 82 180° to shift the positions of the two bobbin holders 84, 86 is effected by a rotary actuator 88; whereas the rotation of the lower bobbin holder 86 to rewind the empty bobbin 16 in the lower holder 86 is effected by a motor 89 via gears 90 and 92.

The bobbin rewinder 80 further includes, as shown in FIG. 8*j*, a mechanical microswitch 93 which senses when the bobbin-holder disc 82 has been rotated 180° by the rotary actuator 88; an optical sensor 94 which senses whether the bobbin in the lower bobbin holder 86 is actually empty; and a cutter 95 actuated by an actuator 96 which cuts the bobbin thread supplied from the supply spool 97 when the rewound bobbin is to be reloaded. Optical sensor 94 senses the colored stripes 34 (FIG. 4) on the bobbin axle 23 to determine that the bobbin within the lower holder 86 is in fact an empty bobbin before the rewinding operation is started; if not, the rewinding operation does not start, but rather, a display (not shown) is actuated to inform the operator that the bobbin in the lower holder 86 is not empty and should be replaced with an empty bobbin.

Figure 8A:
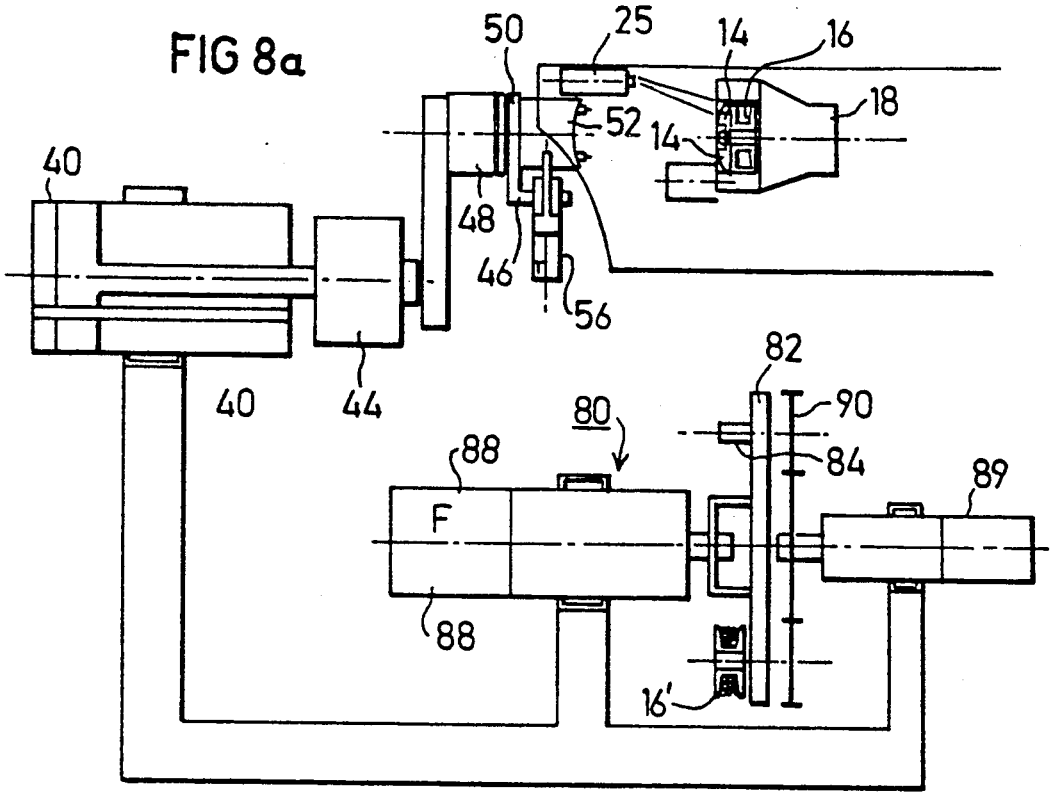

FIGS. 8*a*–8*l* illustrate the sequence of actions occurring during a bobbin-reloading operation:

FIG. 8*a* illustrates the condition of the parts during a normal sewing operation, wherein the bobbin 16 is feeding thread to the sewing needle. During this normal sewing operation, bobbin 16 is rotating, and therefore the optical sensor 25, while scanning end wall 21 (FIGS. 2, 3) of the bobbin 16, outputs a train of pulses corresponding to the radial stripes 24 on the end wall of the bobbin. The normal sewing operation continues so long as sensor 25 continues to output the pulses.

When the bobbin thread 12 becomes exhausted, or broken, bobbin 16 will cease to rotate, and therefore optical sensor 25 will cease to output a train of pulses. As soon as this occurs, the reloading apparatus is actuated according to the following sequence as illustrated in FIGS. 8*b*–8*l*.

Figure 8B:
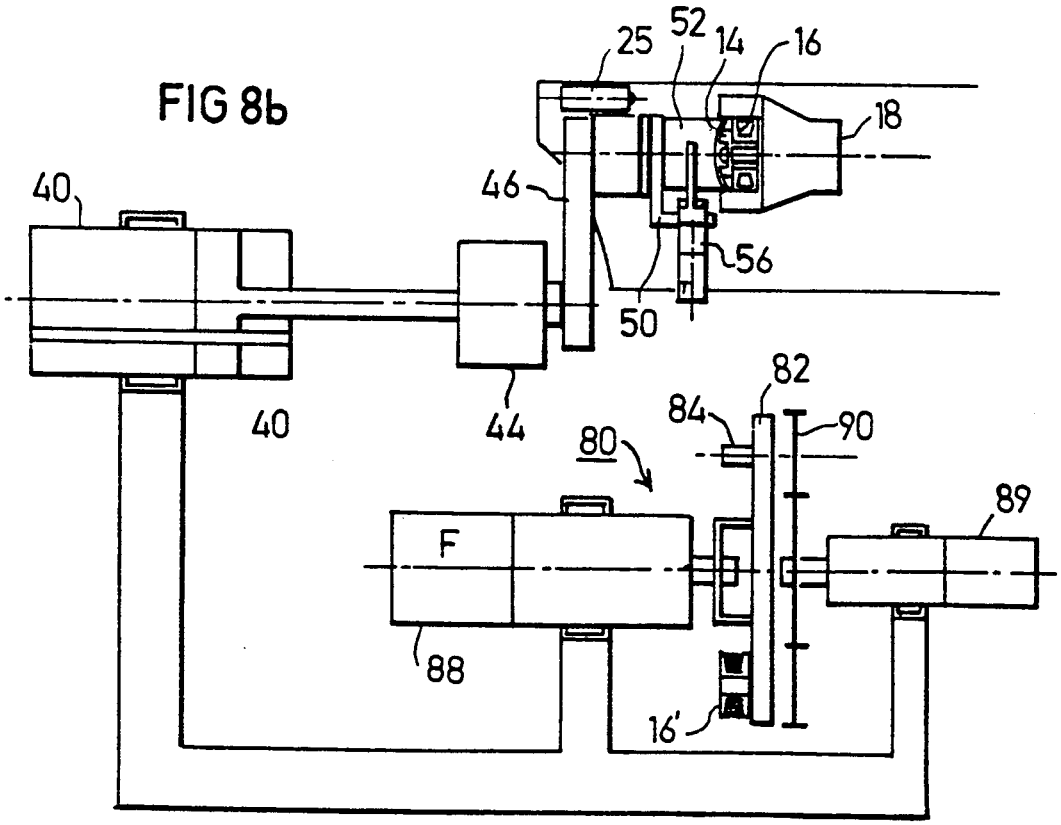

As shown in FIG. 8*b*, linear actuator 40 is energized to bring the extraction head 50 against the bobbin housing 18; and actuator 56 is energized to move its piston stem 58 to its extended position (FIG. 6*b*) actuating threaded shaft 60 and eccentric pin 62, wherein it releases the bobbin 16 and its case 14 from the housing shaft 18*a*. In addition, electromagnet 52 is energized to attract the bobbin case and its bobbin to the extraction head 50.

Figure 8C:
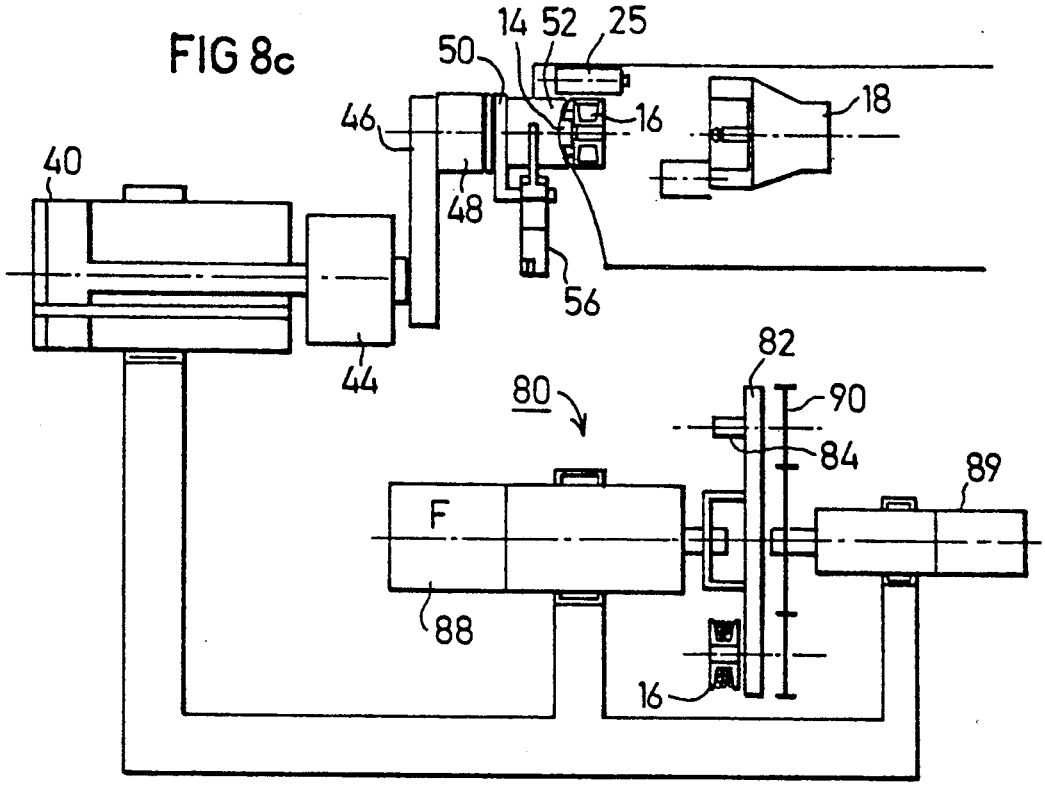
Figure 8D:
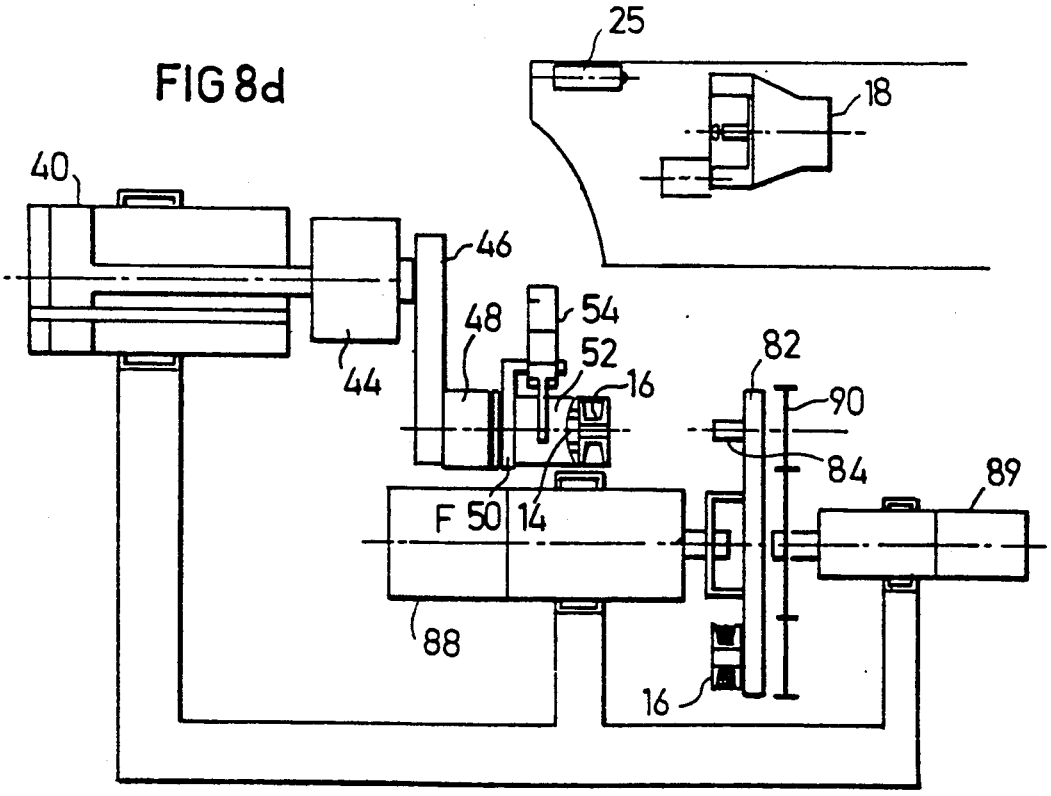

Linear actuator 40 is then returned to its normal position, as shown in FIG. 8*c*, withdrawing the bobbin case and bobbin from the bobbin housing 18. Rotary actuator 44 is then energized to rotate the extraction head 50 180° to bring it, together with the bobbin case and bobbin, into alignment with the upper bobbin holder 84 of the bobbin rewinder 80, as shown in FIG. 8*d*.

Figure 8E:
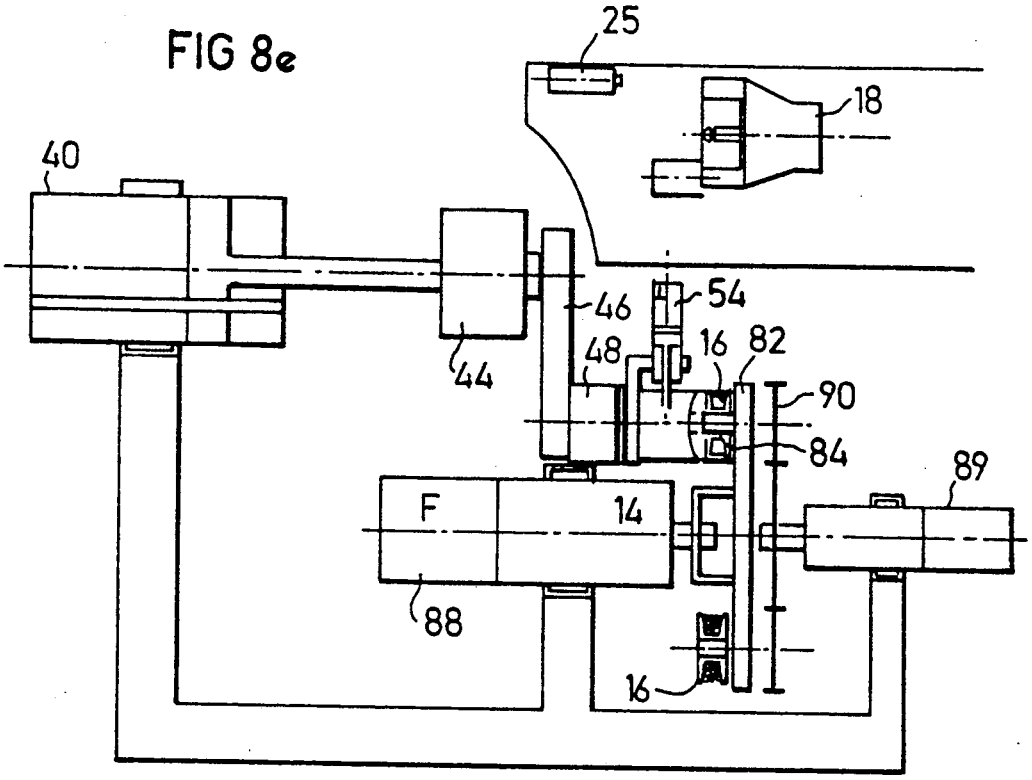
Figure 8F:
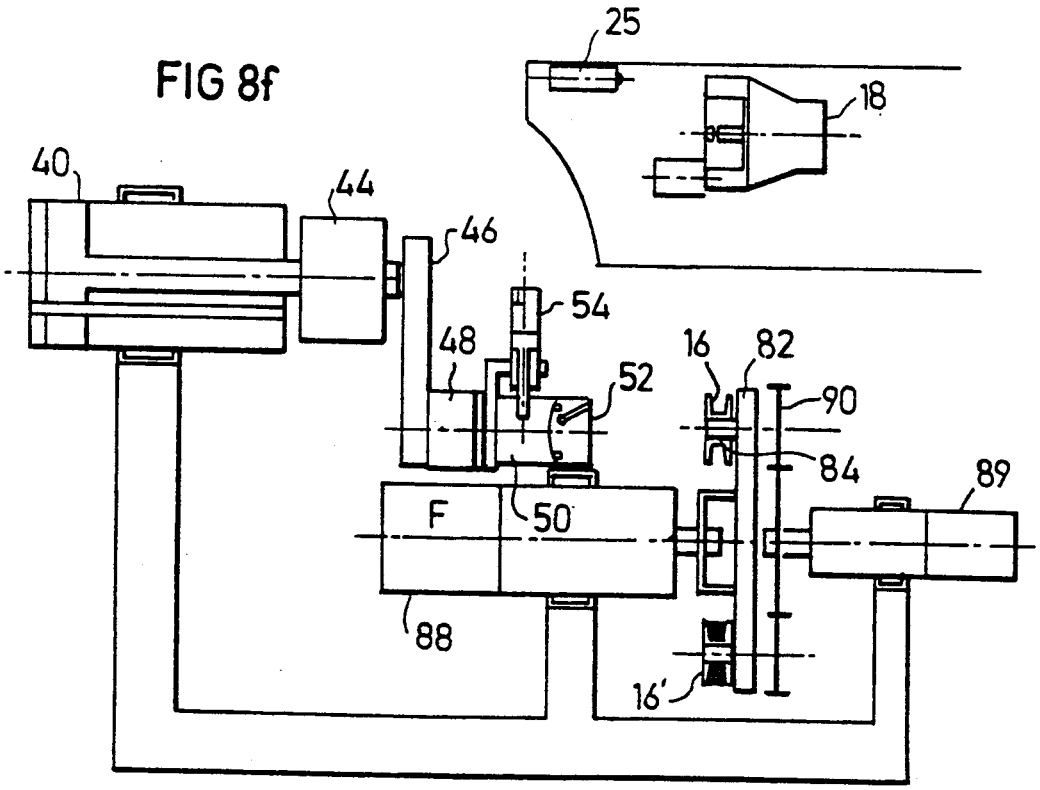

Next, actuator 40 is actuated to insert the extraction head 50, with the bobbin case and the bobbin carried thereby, into the upper bobbin holder 84 of the bobbin rewinder 80; piston stem 58 is then moved by its actuator 56 to its normal (retracted) position wherein leaves locks the bobbin locked to the upper bobbin holder 84, as shown in FIG. 8*e*.

Figure 8G:
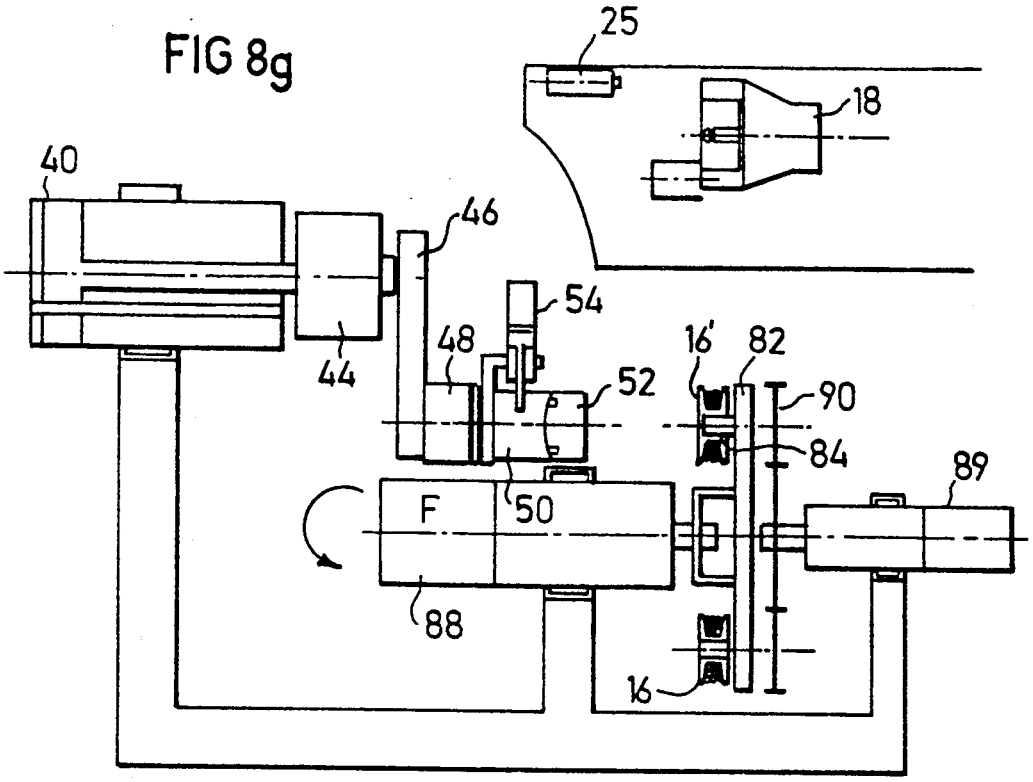

The linear actuator 40 is then returned to its normal position to withdraw the extraction head 50 from the bobbin rewinder while still holding bobbin case 14 by electromagnet 52 (FIG. 8*f*); and rotary actuator 88 of bobbin rewinder 80 is then actuated to rotate the bobbin-holder disc 82 to bring the full bobbin 16' from the lower holder position 86 to the upper holder position 84 (FIG. 8*g*).

Figure 8H:
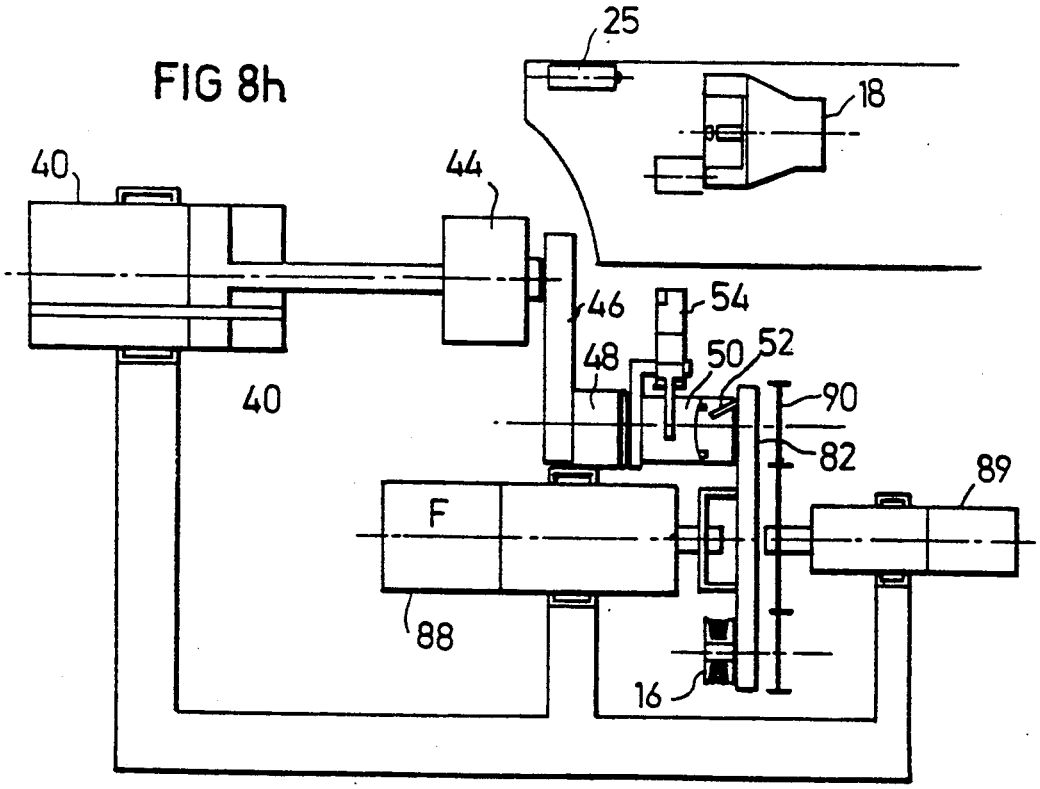

Actuator 40 is then moved to its actuated position to bring the extraction head 50 (holding bobbin case 14) into alignment with the full bobbin 16' now in the upper position of the rewinder; and piston stem 58 is then actuated to its projected position to release the bobbin from holding arm 82, as shown in FIG. 8*h*. In addition, rotary actuator 48 is actuated to rotate the bobbin case 45° in order to bring the bobbin thread 12 under the tensioning spring 66 guided through the diagonal slot 64 in the bobbin case, as described above with respect to FIGS. 7*a* and 7*b*.

Actuator 40 is then returned to its normal position, as illustrated in FIG. 8*i*, to withdraw the filled bobbin and bobbin case with the extraction head 50 from the bobbin rewinder 80, as shown in FIG. 8*i*. Before the start of movement of actuator 40, cutter 95 is actuated by actuator 96 to cut the bobbin thread supplied from the bobbin supply reel 97, as shown in FIG. 8*j*. Upon completion of the cutting operation, actuator 96 rotates the knife out of the way of rotating arm 82.

Figure 8K:
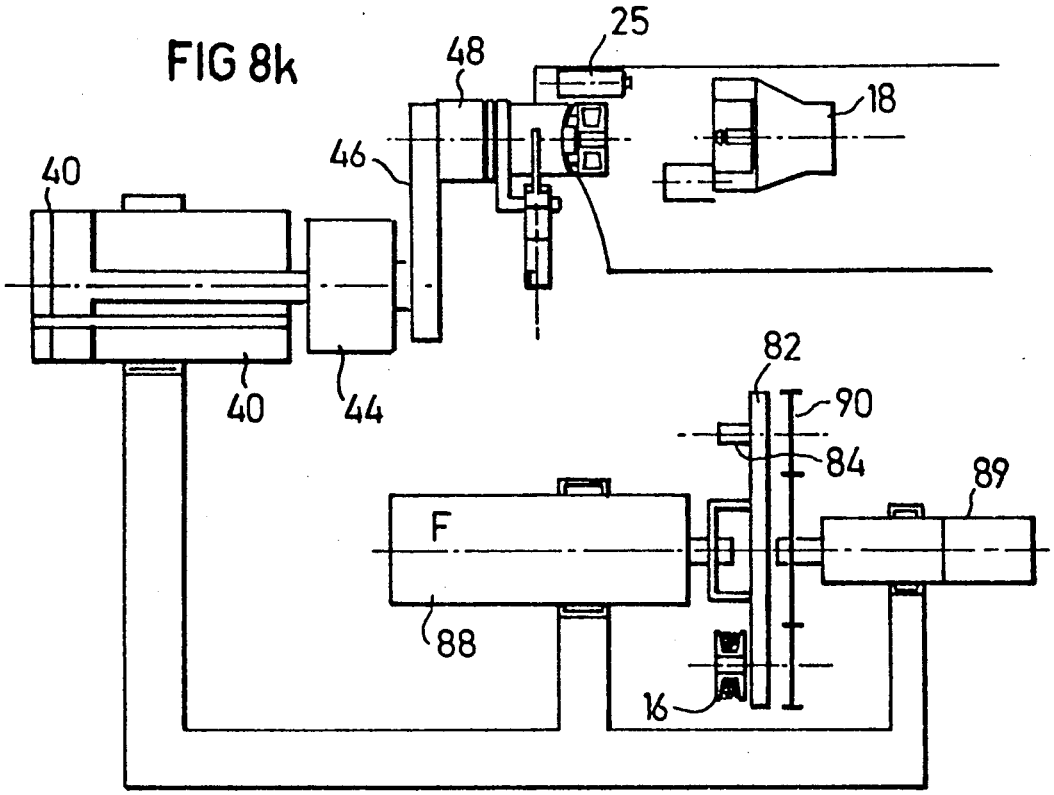
Figure 8K:
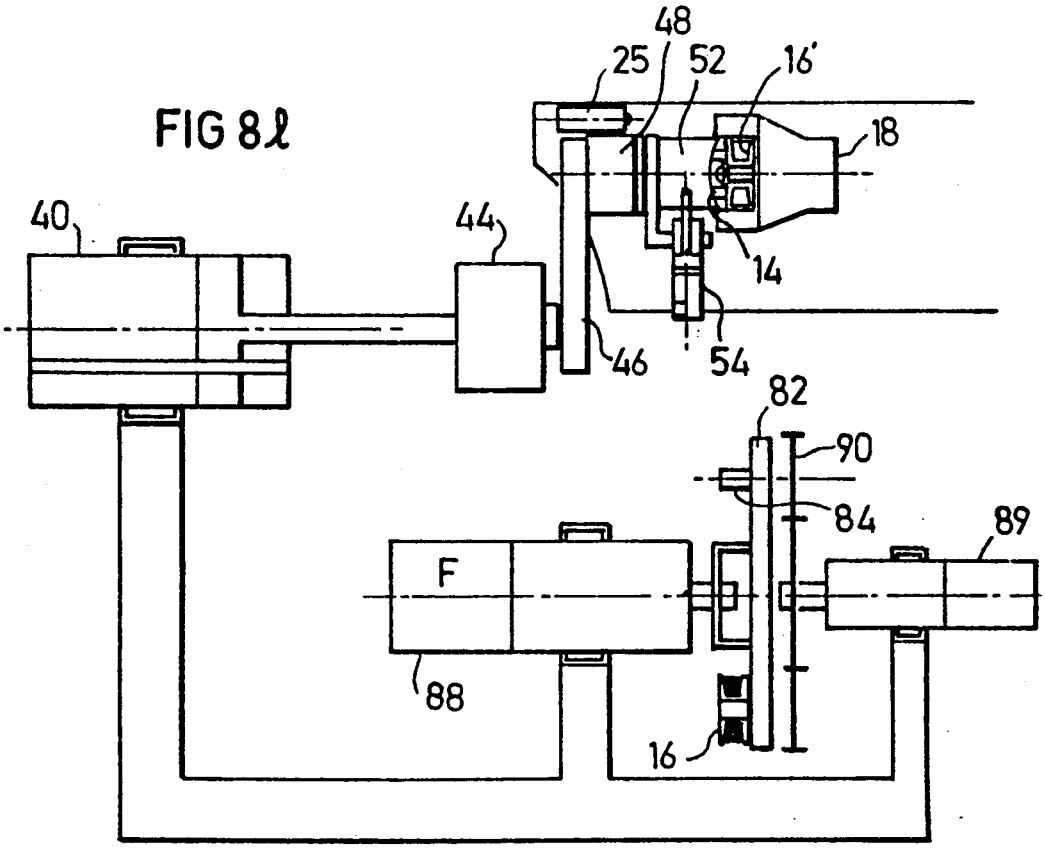

The extraction head 50 with the filled bobbin is then rotated 180° by actuator 44 to bring the extraction head into alignment with the housing 18 of the sewing apparatus, as shown in FIG. 8*k*. Actuator 40 is then energized to its actuated position to apply the insertion head 50, including the filled bobbin and its case, to housing 18, whereupon threaded stem 56 is moved to its normal position to lock the bobbin and case to the housing, as shown in FIG. 8*l*.

During the operation illustrated in FIG. 8*j*, when cutter 95 is actuated to cut the thread, the cutter leaves a short length 12' of thread wound over the axle 23 (held thereon by the friction strips 34) of the bobbin in the lower bobbin holder 86 of disc 82. Motor 88 of the bobbin rewinder 80 is then, or any time thereafter, energized to rotate the lower bobbin holder 86, including the empty bobbin thereon, whereupon the end of the thread is caught by the friction stripes 34 (FIG. 4) to start the rethreading of the bobbin in the lower holder 86. The rotation of the bobbin by motor 88 is continued until the bobbin has been refilled with thread as detected by mechanical microswitch 93.

At the start of the rewinding operation, optical sensor 94 assures that the bobbin in the lower bobbin holder 86 is an empty one, determined by sensing the colored stripes 34 on the axle 23. If the colored stripes 34 are not sensed, this indicates that the bobbin is not empty; and when this occurs, the bobbin rewind motor 88 is not energized but rather a display (not shown) is energized to indicate to the operator that the bobbin is not empty and should be replaced by an empty bobbin. As soon as the bobbin has been replaced by another one, found to be empty by sensor 94, the rewind motor 88 is operated to rewind the bobbin with a fresh supply of thread from supply spool 97. It will be appreciated that the rewinding operation occurs during the normal sewing operation, i.e., after a refilled bobbin has been inserted into the bobbin housing 18.

While the invention has been described with respect to one preferred embodiment, it will be appreciated that many other variations, modifications and application of the invention may be made.

What is claimed is:

1. Sewing apparatus comprising:

a reciprocating sewing needle;

a bobbin within a case for feeding thread to the sewing needle, said bobbin and its case being disposed within a rotary housing which is rotated in synchronism with the reciprocations of the sewing needle;

sensor means for sensing a non-feeding of thread to the sewing needle; and extraction-reloading means automatically effective upon sensing the non-feeding of the thread to the sewing needle, for first extracting the bobbin and its case from the rotary housing, then extracting the bobbin from its case, then reloading the case with another bobbin having a supply of thread thereon and then returning the case with its reloaded bobbin into said rotary housing.

2. Sewing apparatus according to claim 1, wherein said sensor means senses the non-feeding of thread to the sewing needle by monitoring the rotation of the bobbin and producing an electrical signal corresponding to the rotational velocity thereof.

3. Sewing apparatus according to claim 1, further including a bobbin rewinder comprising: a first station for receiving the bobbin extracted by the extraction means; a second station for holding a rewound bobbin containing a supply of thread thereon to be used in automatically reloading the sewing apparatus; means for shifting the extracted bobbin from said first station to said second station; and thread rewinding means at said second station for rewinding a supply of thread on the bobbin in said second station.

4. Sewing apparatus according to claim 3, wherein said bobbin housing, and said bobbin reloading means comprises releasing means for releasing the bobbin and bobbin case from the bobbin housing, and withdrawing means for withdrawing the bobbin and bobbin case from the bobbin housing.

5. Sewing apparatus according to claim 4, wherein said releasing means comprises: a finger slidable in said bobbin case from a first position locking the bobbin case to the bobbin housing, or to a second position releasing the bobbin case from the bobbin housing; a rotary member rotatably mounted on the bobbin case and having an eccentric coupling to said finger such that rotating said rotary member in one direction slides the finger from its one to its other position, and rotating the rotary member in the opposite direction slides the finger from its other position to its one position; and drive means for rotating said rotary member.

6. Sewing apparatus according to claim 5, wherein said drive means comprises an externally threaded shaft meshing with external threads on said rotary member; and a piston for moving said shaft in one direction to rotate said rotary member in one direction, or for moving the shaft in the opposite direction to rotate said rotary member in the opposite direction.

7. Sewing apparatus according to claim 4, wherein said withdrawing means comprises: an electromagnet adapted to be magnetically coupled to the bobbin case; and a linear drive for moving said electromagnet towards said bobbin case when it is to be withdrawn from the bobbin housing.

8. Sewing apparatus according to claim 7, wherein said withdrawing means further comprises a further rotary drive for rotating said electromagnet and the bobbin case, when withdrawn from the bobbin housing, to the bobbin rewinder means for rewinding a fresh supply of thread thereon.

9. Sewing apparatus according to claim 3, wherein said bobbin rewinder comprises a rotary turret carrying a first bobbin holder for receiving the bobbin extracted from the sewing apparatus, and a second bobbin holder for holding the rewound bobbin containing a supply of thread thereon.

10. Sewing apparatus comprising:

a reciprocating sewing needle;

a bobbin within a case for feeding thread to the sewing needle;

said bobbin and its case being disposed within a rotary housing which is rotated in synchronism with the reciprocations of the sewing needle;

sensor means for sensing a non-feeding of thread to the sewing needle; and extraction-reloading means automatically effective, upon sensing the non-feeding of the thread to the sewing needle, for first extracting the bobbin and its case from the rotary housing, then extracting the bobbin from its case, then reloading the case with another bobbin having a supply of thread thereon and then returning the case with its reloaded bobbin into said rotary housing; and a bobbin rewinder including a first station for receiving the bobbin extracted by the extraction-reloading means, a second station for holding a rewound bobbin containing a supply of thread thereon to be used in automatically reloading the sewing apparatus, means for shifting the extracted bobbin from said first station to said second station, and thread rewinding means at said second station for rewinding a supply of thread on the bobbin in said second station.

11. Sewing apparatus according to claim 10, wherein said sensor means senses the non-feeding of thread to the sewing needle by monitoring the rotation of the bobbin and producing an electrical signal corresponding to the rotational velocity thereof.

12. Sewing apparatus according to claim 10, wherein said bobbin extracting-reloading means comprises releasing means for releasing the bobbin and bobbin case from the bobbin housing, and withdrawing means for withdrawing the bobbin and bobbin case from the bobbin housing.

13. Sewing apparatus according to claim 12, wherein said releasing means comprises: a finger slidable in said bobbin case from a first position locking the bobbin case to the bobbin housing, or to a second position releasing the bobbin case from the bobbin housing; a rotary member rotatably mounted on the bobbin case and having an eccentric coupling to said finger such that rotating said rotary member in one direction slides the finger from its one to its other position, and rotating the rotary member in the opposite direction slides the finger from its other position to its one position; and drive means for rotating said rotary member.

14. Sewing apparatus according to claim 13, wherein said drive means comprises an externally threaded shaft meshing with external threads on said rotary member; and a piston for moving said shaft in one direction to rotate said rotary member in one direction, or for moving the shaft in the opposite direction to rotate said rotary member in the opposite direction.

15. Sewing apparatus according to claim 12, wherein said withdrawing means comprises: an electromagnet adapted to be magnetically coupled to the bobbin case; and a linear drive for moving said electromagnet towards said bobbin case when it is to be withdrawn from the bobbin housing.

16. Sewing apparatus according to the claim 15, wherein said withdrawing means further comprises a further rotary drive for rotating said electromagnet and the bobbin case, when withdrawn from the bobbin housing, to the bobbin rewinder means for rewinding a fresh supply of thread thereon.

17. Sewing apparatus according to claim 10, wherein said bobbin rewinder comprises a rotary turret carrying a first bobbin holder for receiving the bobbin extracted from the sewing apparatus, and a second bobbin holder for holding the rewound bobbin containing a supply of thread thereon.

* * * * *